US008702192B2

(12) United States Patent
Danzuka et al.

(10) Patent No.: US 8,702,192 B2
(45) Date of Patent: Apr. 22, 2014

(54) INKJET PRINTING APPARATUS AND METHOD

(75) Inventors: Toshimitsu Danzuka, Tokyo (JP); Kazuo Suzuki, Yokohama (JP); Yutaka Kawamata, Koganei (JP); Masataka Kato, Yokohama (JP); Asako Tomida, Kawasaki (JP); Jumpei Jogo, Kawasaki (JP); Hiroaki Komatsu, Yokohama (JP)

(73) Assignee: Canon Kabushiki Kaisha, Tokyo (JP)

( * ) Notice: Subject to any disclaimer, the term of this patent is extended or adjusted under 35 U.S.C. 154(b) by 158 days.

(21) Appl. No.: 13/188,751

(22) Filed: Jul. 22, 2011

(65) Prior Publication Data

US 2012/0026230 A1 Feb. 2, 2012

(30) Foreign Application Priority Data

Jul. 30, 2010 (JP) ..... 2010-172566

(51) Int. Cl.
*B41J 29/38* (2006.01)
*B41J 23/00* (2006.01)

(52) U.S. Cl.
USPC ..... 347/14; 347/37

(58) Field of Classification Search
None
See application file for complete search history.

(56) References Cited

U.S. PATENT DOCUMENTS 5,543,826 A * 8/1996 Kuronuma et al. ..... 347/23
6,309,051 B1 10/2001 Koitabashi et al.
6,325,492 B1 12/2001 Koitabashi et al.
6,354,691 B1 * 3/2002 Uchikata ..... 347/37
6,572,216 B1 6/2003 Koitabashi et al.
6,918,656 B2 7/2005 Koitabashi et al.
7,517,044 B2 4/2009 Suzuki et al.
7,775,622 B2 8/2010 Suzuki et al.
2003/0067505 A1 * 4/2003 Kumagai ..... 347/35
2004/0145635 A1 * 7/2004 Ebisawa et al. ..... 347/85
2006/0284922 A1 * 12/2006 Beak ..... 347/23
2008/0129775 A1 * 6/2008 Hayakawa ..... 347/23
2009/0079785 A1 * 3/2009 Fukasawa et al. ..... 347/23
2010/0302297 A1 12/2010 Suzuki et al.

FOREIGN PATENT DOCUMENTS

JP 05-261942 A 10/1993

* cited by examiner

*Primary Examiner* — Stephen Meier
*Assistant Examiner* — Alexander C Witkowski
(74) *Attorney, Agent, or Firm* — Fitzpatrick, Cella, Harper & Scinto

(57) ABSTRACT

This invention prevents a possible color mixing, that may occur more than a predetermined time after the wiping operation, by executing a pre-printing cleaning ejection while at the same time minimizing the amount of waste ink produced by the cleaning ejection. To this end, if a color mixing is determined as being likely to occur an elapsed time after the previous wiping operation, the pre-printing cleaning ejection uses a second ink volume U, which represents both the color mixing elimination ink volume and the ejection failure elimination ink volume. If it is decided that there is no likelihood of the color mixing occurring the elapsed time after the wiping operation, the pre-printing cleaning ejection uses the first ink volume D which represents only the ejection failure elimination ink volume.

4 Claims, 7 Drawing Sheets

| RESTING TIME T FROM END OF LAST PRINTING OPERATION TO START OF CURRENT PRINTING OPERATION | 1ST INK VOLUME D FOR PRE-PRINTING CLEANING EJECTION: NUMBER OF ELECTRIC PULSES APPLIED TO HEATER IN EACH EJECTION PORT |
|---|---|
| 0 MINUTE≦T<5 MINUTES | 50 PULSES |
| 5 MINUTES≦T<10 MINUTES | 100 PULSES |
| 10 MINUTES≦T<60 MINUTES | 500 PULSES |
| 1 HOURS≦T<3 HOURS | 1,200 PULSES |
| 3 HOURS≦T<6 HOURS | 2,000 PULSES |
| 6 HOURS≦T<24 HOURS | 3,000 PULSES |
| 24 HOURS≦T<72 HOURS | 5,000 PULSES |
| 72 HOURS≦T<168 HOURS | 7,000 PULSES |
| 168 HOURS≦T | 10,000 PULSES |

TABLE 1

FIG.4A

| RESTING TIME T FROM END OF LAST PRINTING OPERATION TO START OF CURRENT PRINTING OPERATION | 2ND INK VOLUME U FOR PRE-PRINTING CLEANING EJECTION: NUMBER OF ELECTRIC PULSES APPLIED TO HEATER IN EACH EJECTION PORT |
|---|---|
| 0 MINUTE≦T<5 MINUTES | 1,000 PULSES |
| 5 MINUTES≦T<10 MINUTES | 1,000 PULSES |
| 10 MINUTES≦T<60 MINUTES | 1,000 PULSES |
| 1 HOURS≦T<3 HOURS | 1,200 PULSES |
| 3 HOURS≦T<6 HOURS | 2,000 PULSES |
| 6 HOURS≦T<24 HOURS | 3,000 PULSES |
| 24 HOURS≦T<72 HOURS | 5,000 PULSES |
| 72 HOURS≦T<168 HOURS | 7,000 PULSES |
| 168 HOURS≦T | 10,000 PULSES |

TABLE 2

FIG.4B

| RESTING TIME T FROM END OF LAST PRINTING OPERATION TO START OF CURRENT PRINTING OPERATION | INK VOLUME Q FOR EJECTION FAILURE ELIMINATION PRE-PRINTING CLEANING EJECTION: NUMBER OF ELECTRIC PULSES APPLIED TO HEATER IN EACH EJECTION PORT |
|---|---|
| 0 MINUTE≦T<5 MINUTES | 50 PULSES |
| 5 MINUTES≦T<10 MINUTES | 100 PULSES |
| 10 MINUTES≦T<60 MINUTES | 500 PULSES |
| 1 HOURS≦T<3 HOURS | 1,200 PULSES |
| 3 HOURS≦T<6 HOURS | 2,000 PULSES |
| 6 HOURS≦T<24 HOURS | 3,000 PULSES |
| 24 HOURS≦T<72 HOURS | 5,000 PULSES |
| 72 HOURS≦T<168 HOURS | 7,000 PULSES |
| 168 HOURS≦T | 10,000 PULSES |

TABLE A

FIG.6

INKJET PRINTING APPARATUS AND METHOD

BACKGROUND OF THE INVENTION

1. Field of the Invention

The present invention relates to an inkjet printing apparatus used in printers and composite machines.

2. Description of the Related Art

A wide range of research and development has been conducted on the inkjet printing technology because of its advantage of being able to manufacture printers and composite machines with a color print capability at a relatively low cost. The inkjet printing apparatus have been in wide use as commercially available devices of printers and composite machines. The inkjet printing apparatus generally use a print head formed with a plurality of ink ejection ports to eject inks of multiple colors. Such a print head has been known to cause the following troubles when a solvent in ink evaporates from the ink ejection ports increasing a viscosity of ink near the ink ejection ports. They include such phenomena as ejection direction deflections where the ink droplet ejection direction becomes deflected and ejection failures where ink droplets cannot be ejected.

Countermeasures against these troubles incorporated in general inkjet printing apparatus include a capping unit to minimize a vaporization of ink solvent from the ink ejection ports and a viscous ink expelling unit to expel useless viscous ink out of the ejection ports to the outside of a print medium before starting a printing session. Further, because foreign matters adhering to the print head surface near the ink ejection ports can cause ejection direction deflections and ejection failures, the print head also has a wiping unit to wipe clean the ink ejection port surface of the print head.

For reduced size and cost, many of the inkjet printing apparatus of recent years have a plurality of ink ejection ports for a plurality of color inks formed in essentially a single ink ejection port surface so that it can be wiped by a single wiper. Such an inkjet printing apparatus has been known to produce a so-called color mixing phenomenon in which some color inks get into ink ejection ports of other color inks during the wiping operation.

Japanese Patent Laid-Open No. H05-261942(1993) discloses a technique to deal with this problem. The inkjet printing method disclosed in the Japanese Patent Laid-Open No. H05-261942(1993) prevents the color mixing problem by executing a cleaning ejection following the wiping operation before starting the printing operation on a print medium.

However, experiments conducted by the inventors of this invention have found that, under the following circumstance, the color mixing phenomenon can still occur even if the cleaning ejection following the wiping operation has been done before the printing operation on a print medium is started. The experimental operations were conducted in the following procedure. First, following a wiping operation, a cleaning ejection is performed using a volume of ink for each of color inks that prevent the color mixing from occurring if a printing operation is done on a print medium immediately after the cleaning ejection. (This cleaning ejection performed following the wiping operation is also called a post-wiping cleaning ejection; and the volume of ink used in the post-wiping cleaning ejection is also called an optimal ink volume for post-wiping cleaning ejection.) Then, after a lapse of a predetermined time following the cleaning ejection, the printing operation is performed on a print medium. With this experiment it has been confirmed that the color mixing can result when the printing operation is done more than the predetermined time after the cleaning ejection.

SUMMARY OF THE INVENTION

An object of this invention is to provide an inkjet printing apparatus which prevents a possible color mixing, that may occur when an elapsed time from the wiping operation is more than a predetermined time, by executing a pre-printing cleaning ejection while at the same time minimizing the amount of waste ink produced by the cleaning ejection. The color mixing that may occur more than a predetermined elapsed time after the wiping operation is also referred to as a post-wiping elapsed time color mixing.

An inkjet printing apparatus comprising: a printing unit to execute a printing operation by ejecting a plurality of color inks from a plurality of ink ejection ports formed therein; a wiping unit to wipe a surface of the printing unit in which the ejection ports are formed; a capping unit to hermetically close the ejection ports with a cap; and a cleaning ejection unit to execute cleaning ejections for expelling inks not suited for the printing operation from the printing unit; wherein, when an elapsed time from a previous wiping operation until the capping unit opens the cap is less than a predetermined period, the cleaning ejection unit executes a cleaning ejection using a first ink volume for each color ink immediately before the printing operation to eliminate a possible failure to eject inks from ejection ports, the first ink volume being able to eliminate the possible ink ejection failure from ejection ports immediately after the wiping operation, the first ink volume increasing with an increasing resting time measured from an end of a last printing operation to a start of a current printing operation; wherein, when the elapsed time is equal to or more than the predetermined period, the cleaning ejection unit executes the cleaning ejection using a second ink volume for each color ink immediately before the printing operation to eliminate a possible color mixing at the ejection ports, the second ink volume being at least able to eliminate the possible color mixing that may occur at the ejection ports the elapsed time after the previous wiping operation, the second ink volume increasing with the increasing resting time.

With this invention, the inkjet printing apparatus checks the elapsed time from the previous wiping operation until the capping unit opens the cap. Then, if it is decided that the elapsed time is less than a predetermined period, the cleaning ejection unit executes a cleaning ejection using a first ink volume for each color ink immediately before the printing operation to eliminate a possible failure to eject inks from ejection ports, the first ink volume being able to eliminate the possible ink ejection failure from ejection ports immediately after the wiping operation, the first ink volume increasing with the increasing resting time which elapsed from the end of the last printing operation to the start of the current printing operation.

If the elapsed time is found to be more than a predetermined period, the cleaning ejection unit executes the cleaning ejection using a second ink volume for each color ink immediately before the printing operation to eliminate a possible color mixing at the ejection ports, the second ink volume being at least able to eliminate the possible color mixing that may occur at the ejection ports the elapsed time after the previous wiping operation, the second ink volume increasing with the increasing resting time. With these construction, an inkjet printing apparatus can be provided which prevents a possible color mixing that may occur when the elapsed time from the previous wiping operation becomes more than a predetermined period, by executing a pre-printing cleaning ejection while at the same time minimizing the amount of waste ink produced by the cleaning ejection.

Further features of the present invention will become apparent from the following description of exemplary embodiments (with reference to the attached drawings).

BRIEF DESCRIPTION OF THE DRAWINGS

FIG. 4A is a table stored in the printing apparatus of FIG. 1;

FIG. 4B is a table stored in the printing apparatus of FIG. 1;

FIG. 6 is a table stored in the printing apparatus of the second embodiment.

DESCRIPTION OF THE EMBODIMENTS

First Embodiment

Figure 1:
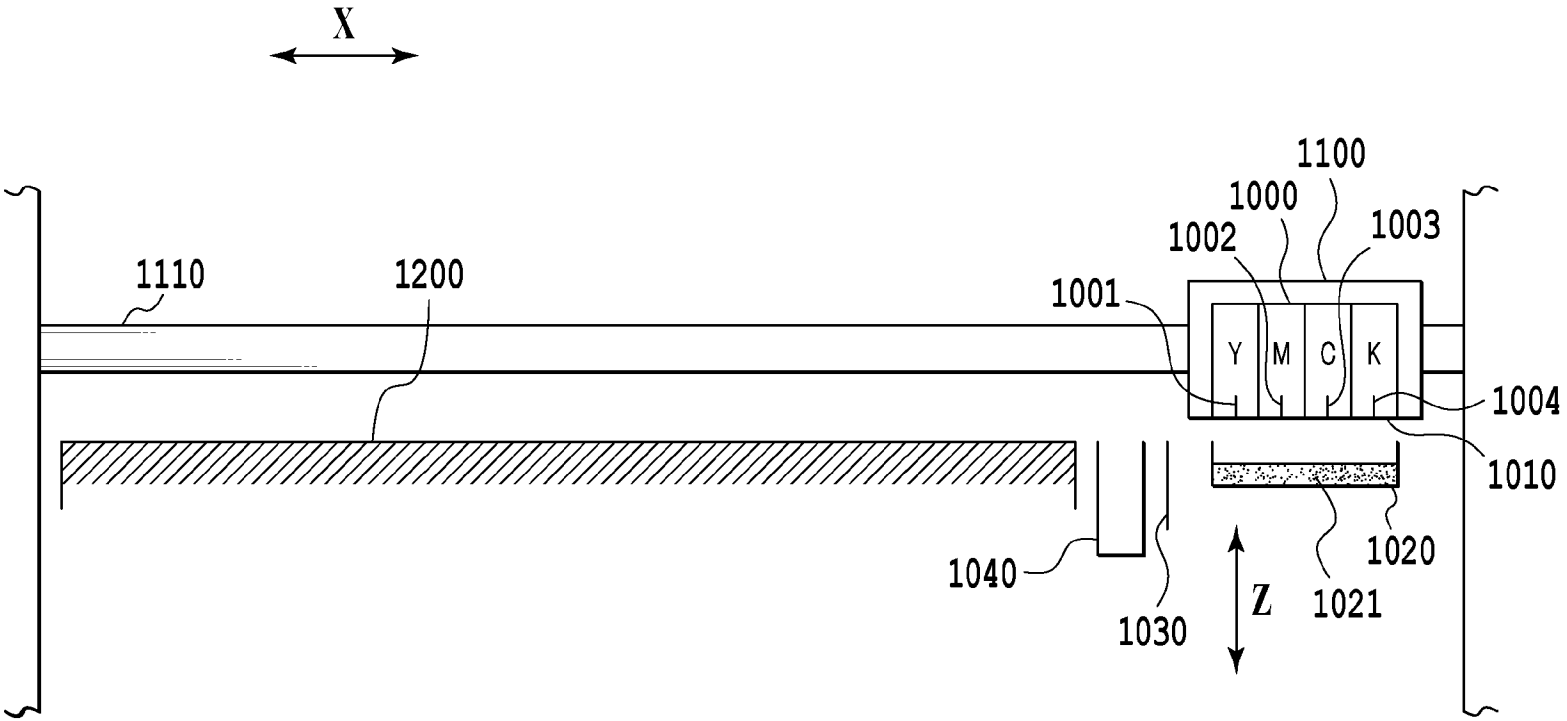
FIG. 1 is a schematic cross section showing an essential portion of an inkjet printing apparatus as a preferred embodiment of this invention.

Now, a first embodiment of this invention will be described by referring to the accompanying drawings. FIG. 1 is a schematic cross section showing an essential portion of an inkjet printing apparatus as a preferred embodiment of this invention. An inkjet print head 1000 has a plurality of ink ejection port arrays 1001, 1002, 1003, 1004 each assigned to eject yellow, magenta, cyan and black ink respectively, each array consisting of a plurality of ink ejection ports aligned in a Y direction perpendicular to the plane of a drawing sheet. The arrays of ink ejection ports for the respective ink colors are formed in an ink ejection port surface 1010. In each of the ink ejection ports there is provided an electrothermal converter or heater which, when applied an electric signal based on a drive signal, generates a bubble in ink to expel an ink droplet from the ejection port by the pressure of the bubble. The inks of yellow, magenta, cyan and black are supplied from ink tanks not shown.

The inkjet print head 1000 (printing unit) is mounted on a carriage 1100 that is reciprocally scanned along a guide shaft 1110 in a direction of arrow X by a carriage motor not shown. The reciprocal scanning in the direction X of the carriage 1100 is done while the print medium is at rest following its intermittent feed or conveyance over a platen 1200 by an intermittent operation of a conveyance motor. During this reciprocal scan of the carriage 1100, the color inks are ejected from the ink ejection port arrays 1001, 1002, 1003, 1004 of the inkjet print head 1000 onto the print medium to form an image thereon. With an alternate operation of the intermittent conveyance of the print medium and of the ink ejection from the ink ejection ports during the reciprocal scan of the carriage 1100 repeated for one sheet of the print medium, the printing on the sheet is complete.

Further, to minimize the evaporation of a solvent in ink from the ink ejection ports, a cap 1020 hermetically covers the ink ejection ports of different colors. The cap 1020 is reciprocally moved by a known device in a direction of arrow Z between a capping position and a parted position. In the cap 1020 there is provided an ink absorbent 1021. A wiper blade 1030 is reciprocally moved by a known device in a direction of arrow Z between a wiping position and a retracted position to wipe the ink ejection port surface 1010 clean.

The wiper blade 1030, located at the retracted position when not in use, advances to the wiping position during the wiping operation whereby the carriage 1100 is moved in the direction of arrow X to have its ink ejection port surface 1010 wiped clean by the blade. Further, a cleaning ejection ink receiver 1040 receives viscous ink not suitable for printing that is expelled from within the ejection ports by a cleaning ejection. The viscous ink thus expelled is led to a waste ink container not shown.

Figure 2:
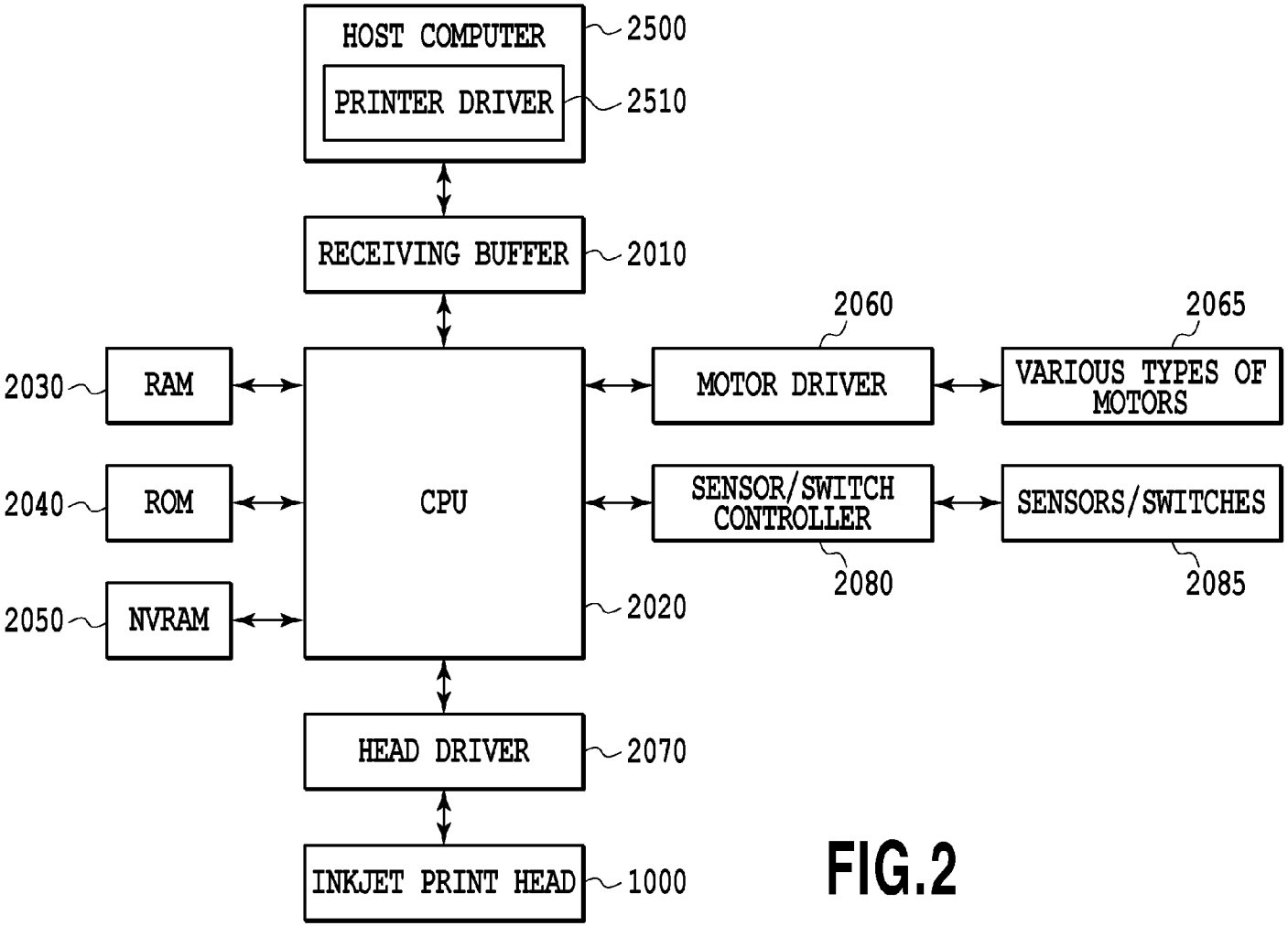
FIG. 2 is a block diagram showing a control system of the inkjet printing apparatus of FIG. 1.

FIG. 2 is a block diagram showing a control system for the inkjet printing apparatus of this embodiment. In FIG. 2, a host computer 2500 is connected to the inkjet printing apparatus via a USB interface. A printer driver 2510 is stored in the host computer 2500 in the form of software. In response to a print command from the user, the printer driver 2510 generates print data from image data of user's desired documents and photographs and sends them to the inkjet printing apparatus. A receiving buffer 2010 stores the print data and others that have been transmitted from the host computer 2500 to the inkjet printing apparatus. The print data stored in the receiving buffer 2010 is transferred to a RAM 2030 under the management of CPU 2020 for a temporary storage. A ROM 2040 stores programs and fixed data necessary for a variety of controls of the inkjet printing apparatus.

A non-volatile memory NVRAM 2050 stores information that needs to be kept in the event of a power interruption in the inkjet printing apparatus. Further, a motor driver 2060 drives various motors 2065 such as carriage motor and conveyance motor. Denoted 2070 is a head driver to drive the inkjet print head 1000. A sensor/switch controller 2080 controls various sensors and switches 2085.

The cause of the color mixing that occurs when the ink head has been left unused for a predetermined time after the wiping of the ink ejection port surface 1010 will be briefly explained as follows. First, the ink color mixing itself occurs when the ink ejection port surface 1010 formed with a plurality of ink ejection ports of various color inks is wiped. Experiments conducted by the inventors of this inventions have found that the inks that have been mixed on the ink ejection port surface 1010 by the wiping operation also move into ejection ports of various color inks while at the same time a small amount of mixed color inks escapes being wiped out by the wiper blade 1030 and remains on the ink ejection port surface 1010. Although the mixed color inks that have entered into the ink ejection ports are expelled by the cleaning ejection following the wiping operation, the mixed color inks remaining on the ink ejection port surface 1010 are not removed by the cleaning ejection but stay there.

The mixed color inks remaining on the ink ejection port surface 1010, particularly the ones staying on the ink ejection port surface 1010 near the ink ejection ports, absorb water in the ambience and spread out. When the on-surface remaining inks come into contact with the ink in the ejection ports, they are easily drawn into the ejection ports because there is a negative pressure in the ejection ports. If the mixed color inks have entered into the ejection ports a predetermined time after the wiping operation, as described above, a cleaning ejection needs to be performed using a predetermined volume of each of color inks (hereinafter referred to as a color mixing elimination volume) to prevent a possible color mixing.

Such a phenomenon is considered to be the cause of the color mixing that can occur when the print head has not been activated for a predetermined time after the wiping operation. Experiments conducted by the inventors of this invention have found that, for the post-wiping color mixing to occur, the time that needs to elapse from the wiping operation is 10 minutes. With this cause for the color mixing in mind, a print sequence in this embodiment of the inkjet printing apparatus with the aforementioned construction will be explained by referring to FIG. 3 and FIGS. 4A and 4B.

Figure 3:
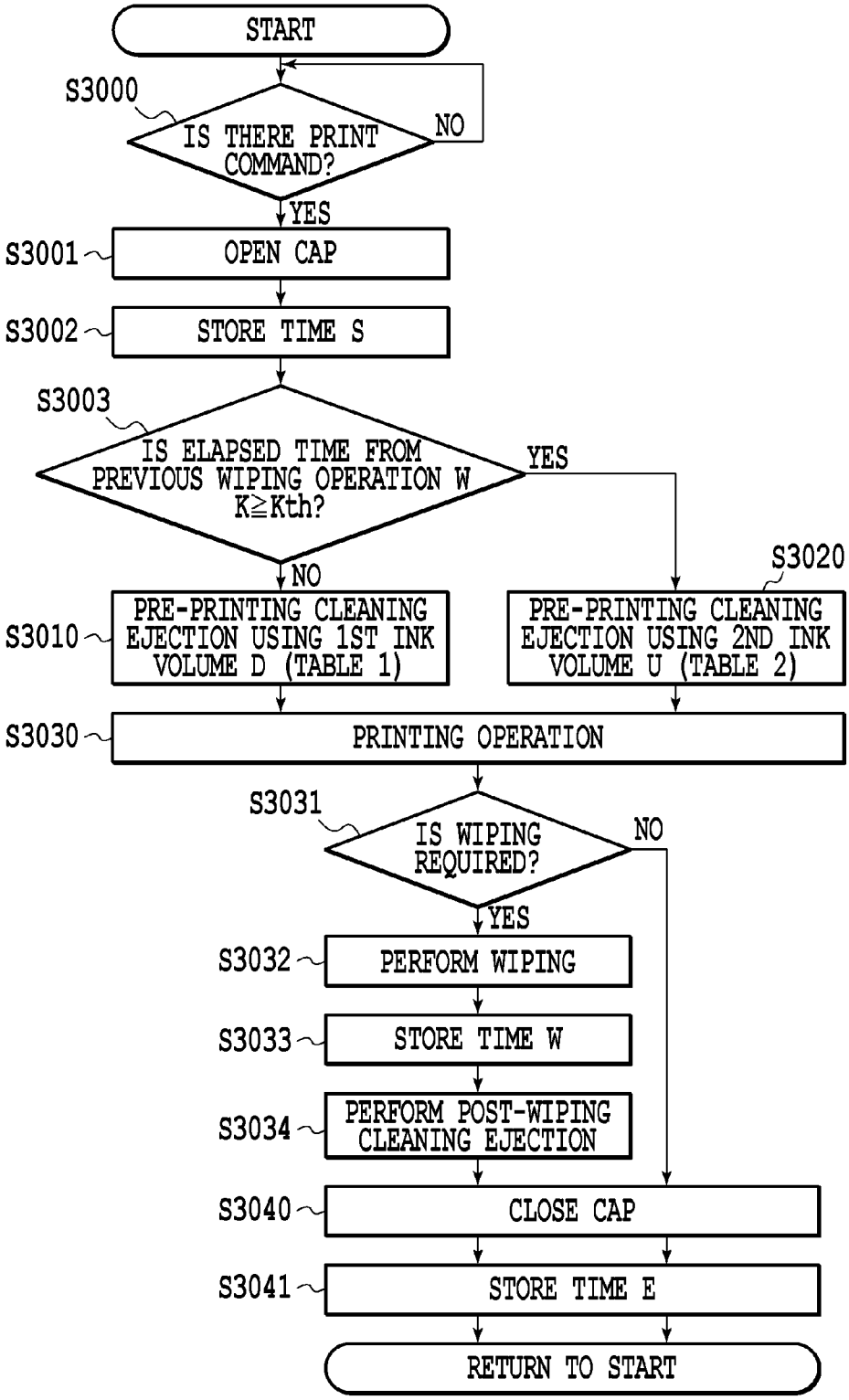
FIG. 3 is a flow chart showing a printing operation sequence in a first embodiment.

FIG. 3 shows a flow chart of a print sequence in this embodiment. FIGS. 4A and 4B show tables stored in the inkjet printing apparatus. According to this flow chart, the print sequence of this embodiment will be explained. At the start of the print sequence, step S3000 checks for the presence or absence of a print command sent from the host computer 2500. If a print command is found, the print sequence moves to step S3001 where it displaces the cap 1020 from the inkjet print head 1000 until the cap stops at the parted position. Step S3002 stores the cap opening time S in the RAM 2030.

Then, step S3003 references the NVRAM 2050 to see if the time length K that has elapsed from the last wiping operation time W to the cap opening time S is equal to or greater than a predetermined time length (first predetermined period) Kth. In this example, the aforementioned 10 minutes is taken as the predetermined time length Kth. If the decision made at step S3003 is negative, i.e., the time length K is less than 10 minutes (predetermined period), the sequence proceeds to step S3010. Step S3010 executes the pre-printing cleaning ejection onto the cleaning ejection ink receiver 1040 using a first predetermined ink volume (second predetermined volume) D specified in a table 1 of FIG. 4A in the order of yellow, magenta, cyan and black ink successively as the carriage 1100 starts to scan immediately before the printing operation.

That is, depending on the resting time from the end of the last printing operation on the print medium (a time E to be described later) to the start of the current printing operation (the cap opening time S), the cleaning ejection using the first predetermined ink volume D, or an ejection failure elimination ink volume, is performed. Then the sequence moves to step S3030 where it executes printing on the print medium. When the printing on the print medium has finished, the sequence proceeds to step S3031. Step S3031 determines whether the wiping operation is necessary or not by checking if the volume of each color ink used in the printing operation has exceeded a threshold.

If the decision of step S3031 is positive, i.e., the wiping operation is determined necessary, the sequence moves to step S3032 where it executes the wiping operation. Then, at step S3033 the wiping operation time W is stored in a predetermined address in the NVRAM 2050. The next step S3034 performs a post-wiping cleaning ejection toward the cleaning ejection ink receiver 1040 for individual color inks successively. The optimal ink volume for post-wiping cleaning ejection represented by the number of electric signal pulses applied to the electrothermal converter (or heater) in each ink ejection port is 200 pulses. That is, the cleaning ejection of 200 pulses can eliminate the color mixing that may occur immediately after the wiping operation.

With the post-wiping cleaning ejection done, step S3040 moves the cap 1020 to the capping position to hermetically cover the ink ejection ports. Then, step S3041 stores the head capping time E in a predetermined address in the NVRAM 2050. In the next printing operation on a print medium, this head capping time E will be used as the end time of the previous printing operation. After step S3041, the sequence returns to the start where it waits for the next print command from the host computer 2500.

If, on the other hand, step S3031 decides that the wiping operation is not necessary, the sequence moves to step S3040 to cap the print head without performing the wiping operation. The head capping time E is stored in a predetermined address in the NVRAM 2050 (step S3041). Then the sequence returns to the start where it waits for the next print command from the host computer 2500.

If step S3003 finds that the time length K that has elapsed from the previous wiping operation time W exceeds the predetermined time length Kth (10 minutes or more)(predetermined period or more), the mixed inks on the ink ejection port surface of the print head may absorb water in the ambience and spread into the ejection ports, resulting in a post-wiping color mixing. To deal with this problem, the sequence moves to step S3020 where it performs the pre-printing cleaning ejection onto the cleaning ejection ink receiver 1040 using a second predetermined ink volume U specified in a table 2 of FIG. 4B for individual color inks successively. In comparison with the table 1 of FIG. 4A, the table 2 of FIG. 4B shows increased cleaning ejection ink volumes that need to be used to eliminate color mixing and ejection failures that may occur when the print head is left at rest for up to 60 minutes (second predetermined period). That is, if the time length K that has passed from the last wiping operation time W is 10 minutes or more, a pre-printing cleaning ejection using the second predetermined ink volume U, which is a color mixing elimination volume and an ejection failure elimination volume, is performed according to the resting time T.

According to the experiments conducted by the inventors of this invention, the color mixing elimination ink volume (first predetermined ink volume) is 1000 pulses. Referring to FIG. 4A, table 1 shows 50-500 pulses for the resting time T of less than 60 minutes, which is smaller than 1,000. In other words, the color mixing elimination ink volume of 1,000 pulses is larger than the ejection failure elimination ink volume of 50-500 pulses. So, in FIG. 4B, the relation between the resting time and the second predetermined ink volume U for the pre-printing cleaning ejection is so set that, for the resting time T of less than 60 minutes, the color mixing elimination ink volume of 1,000 pulses is used and that, for the resting time of 60 minutes or more, the same cleaning ejection ink volumes as those of table 1 are used. That is, for the resting time of less than 60 minutes, the pre-printing cleaning ejection of more than the color mixing elimination ink volume (first predetermined ink volume) needs to be performed to eliminate possible color mixing.

When the pre-printing cleaning ejection using the second predetermined ink volume U according to the resting time T is done, the sequence moves to step S3030 where it performs printing on a print medium. The subsequent sequence is similar to the one followed when the result of step S3003 is negative.

The experiments done by the inventors has shown that when a cleaning ejection using the post-wiping optimal ink volume is performed without executing the wiping operation, no color mixing has been found even when 10 minutes (predetermined time) or more has passed after the cleaning ejection. So, if no wiping operation is done, there is no need to increase the ink volume for the pre-printing cleaning ejection.

With the inkjet printing apparatus constructed and controlled as described above, if there is a possibility that a color mixing may occur the elapsed time after the wiping operation, a pre-printing cleaning ejection is performed using the second predetermined ink volume U, which represents both the color mixing elimination ink volume and the ejection failure elimination ink volume. If on the other hand there is no possibility of the post-wiping color mixing occurring, a pre-printing cleaning ejection is performed using the first predetermined ink volume D, which represents the ejection failure elimination ink volume. This allows for preventing the color mixing that may otherwise occur the elapsed time after the wiping operation while at the same time minimizing the amount of waste ink produced by the pre-printing cleaning ejections.

Second Embodiment

A second embodiment of this invention will be described by referring to the accompanying drawings. Since the basic construction of this embodiment is similar to that of the first embodiment, explanation will be given only to the characteristic construction.

The construction to be explained here with an example case is characterized by its capability to prevent a possible color mixing that may otherwise occur the elapsed time after the wiping operation, while at the same time minimizing the amount of waste ink produced by the pre-printing cleaning ejections.

Figure 5:
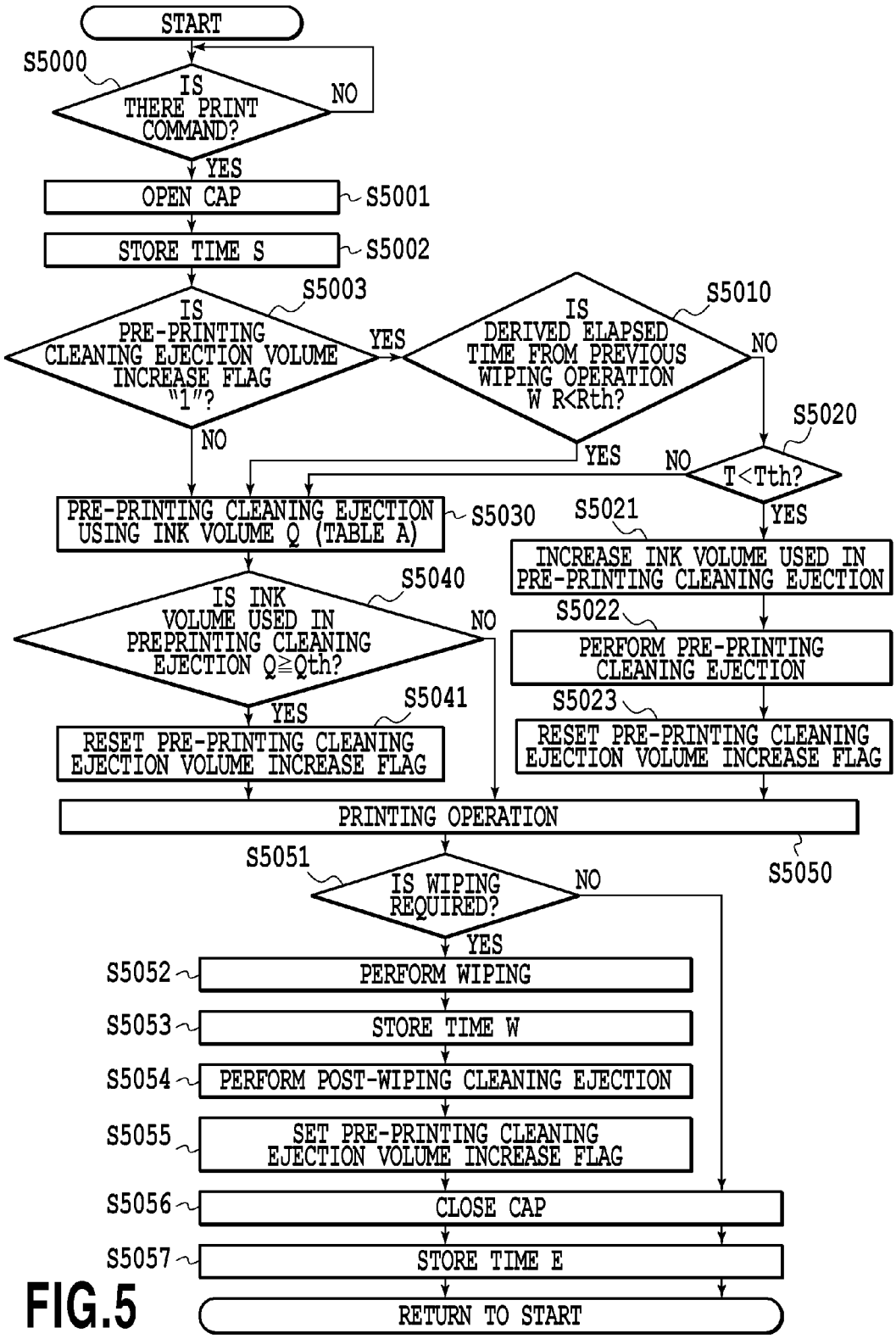
FIG. 5 is a flow chart showing a printing operation sequence in a second embodiment.

FIG. 5 is a flow chart showing a print sequence of this embodiment and FIG. 6 shows a table A stored in the inkjet printing apparatus of this embodiment. The print sequence of this embodiment will be explained by referring to the flow chart of FIG. 5.

Once the print sequence starts, step S5000 checks for presence or absence of a print command sent from the host computer 2500. If the print command is found, the sequence proceeds to step S5001 where it opens the cap 1020 and moves it to the parted position. Then at step S5002 the cap opening time S is stored in the RAM 2030. Then at step S5003, a check is made to see if a pre-printing cleaning ejection volume increase flag (explained later) is set. If step S5003 decides that the flag is not set, the sequence moves to step S5030.

Then, the pre-printing cleaning ejection onto the cleaning ejection ink receiver 1040 is performed using an ink amount Q specified in table A of FIG. 6 for individual color inks successively as the carriage 1100 starts to scan. That is, depending on the resting time T from the end of the last printing operation (time E described later) to the start of the current printing operation, the pre-printing cleaning ejection is performed using the ejection failure elimination ink volume Q. Then, at step S5040 a check is made as to whether the ink volume Q used in the pre-printing cleaning ejection done at step S5030 is equal to or greater than the threshold Qth (color mixing elimination ink volume). The threshold Qth in this embodiment is represented by the number of electric signal pulses applied to each electrothermal converter (or heater) and in this case is 1,000 pulses. The threshold Qth, or the color mixing elimination ink volume, is an ink volume that can eliminate a possible color mixing that may otherwise occur a predetermined elapsed time after the wiping operation.

If, at step S5040, its decision is positive, i.e., if it is found that the resting time T is one hour or more and that the ink volume Q used in the pre-printing cleaning ejection at step S5030 is equal to or greater than the threshold Qth, the sequence proceeds to step S5041 where it resets the pre-printing cleaning ejection volume increase flag to "0". However, when the print sequence is executed for the first time and reaches step S5041 following the path described above, the pre-printing cleaning ejection volume increase flag is already "0" before it is reset.

Then, at step S5050 the printing operation is performed on a print medium. If on the other hand the decision at step S5040 is negative, i.e., if it is found that the resting time T is less than one hour and that the ink volume Q of the pre-printing cleaning ejection is less than the threshold Qth (color mixing elimination ink volume), the sequence moves to step S5050 where it executes the printing operation on a print medium. When the printing operation at step S5050 is finished, the sequence moves to step S5051 to check whether the known wiping operation is necessary or not, as in the first embodiment.

If the decision of step S5051 is positive, i.e., if it is determined that the wiping operation is necessary, the sequence moves to step S5052 to execute the wiping operation. Then at step S5053 the wiping operation time W is stored in a specified address in the NVRAM 2050. Then step S5054 executes the post-wiping cleaning ejection onto the cleaning ejection ink receiver 1040 using an optimal ink volume (200 pulses the same as in the first embodiment) for individual color inks successively. The sequence then moves to step S5055 where it sets the pre-printing cleaning ejection volume increase flag in the NVRAM 2050 to "1". Then at step S5056, it moves the cap 1020 to the capping position to hermetically cover the ejection port surface of the print head.

If on the other hand the decision by step S5051 is negative, i.e., if it is decided that the wiping operation is not necessary, the sequence, without performing the wiping operation, moves to step S5056 where it closes the cap.

After the capping operation is done at step S5056, the capping time E is stored in a specified address in the NVRAM 2050 at step S5057. When the printing operation on a print medium is performed the next time, this capping time E represents the end of the last printing operation. When step S5057 is finished, the sequence returns to the top where it waits for a print command from the host computer 2500.

Returning to step S5003 again, if the decision by the step S5003 is positive, i.e., if "1" is set in the pre-printing cleaning ejection volume increase flag, the sequence moves to step S5010. At step S5010, a check is made to see if an elapsed time R (minutes), that elapses from the last wiping operation time W and which is derived from a capping period C (minutes) and a non-capping period H (minutes), is less than a threshold value Rth (minutes). The capping period is the time during which the cap 1020 caps and engages the ink ejection port surface 1010, and the non-capping period is the time during which the cap 1020 is parted from the ink ejection port surface 1010.

Here the derived elapsed time R will be explained. But first, let us explain about the capping period C that has passed from the previous wiping operation time W. When, for example, the wiping operation was done at the end of the last printing operation, the capping period C lasting from the previous wiping operation time W is given as follows.

(Capping Period C from the Previous Wiping Operation Time *W*)=(capping period that has passed from the end time *E* of the last printing operation to the start time of the current printing operation)

Further, if the wiping operation was done following the printing operation before last but if the wiping operation was not done following the last printing operation, the capping period C lasting from the previous wiping operation time W can be expressed as follows.

(Capping period *C* from the previous wiping operation time *W*)=(capping period that has passed from the end time *E* of the printing operation before last to the start time *S* of the last printing operation)+(capping period that has passed from the end time *E* of the last printing operation to the start time *S* of the current printing operation)

It is noted that, if the printing operation is interrupted due to ink running out and the print head is capped until the ink is supplied, this capping period is also added. These periods of time combine to constitute the capping period C that elapsed from the previous wiping operation time W.

The non-capping period H lasting from the previous wiping operation time W is expressed as follows.

(Non-capping period $H$ from the previous wiping operation time $W$)=(elapsed time from the previous wiping operation time $W$ to the start time $S$ of the current printing operation)−(capping period $C$ from the previous wiping operation time $W$)

Most of the non-capping period H is spent printing on a print medium. Based on the capping time C from the previous wiping operation time W and the non-capping period H, the elapsed time R is derived. In this embodiment, the elapsed time R is derived from the following equation.

(Derived elapsed time $R$)=$e$×(capping period $C$ from the previous wiping operation time $W$)+$f$×(non-capping period H from the previous wiping operation time $W$)

The coefficient e used here is 0.8 and f 0.2.

Here the reason for the use of the coefficients e and f is explained as follows. As described above, the different color inks, that have mixed together on the ink ejection port surface 1010 as a result of the wiping action and escaped being removed by the wiper blade 1030, remain on the ink ejection port surface 1010 and absorb water in the ambience to spread and get into ink ejection ports. This phenomenon is considered to be the cause of the color mixing that occurs the elapsed time after the wiping operation. The amount of water in the ambience varies greatly between the capped state and the non-capped state and is generally greater during the capped state.

This is because the capping operation hermetically closes the ink ejection port surface 1010 in a small closed space and the humidity in that closed space is generally much higher than that outside the closed space. When the humidity in the closed space is high as described above, the mixed color inks that escaped being removed by the wiper blade 1030 and remain on the ink ejection port surface 1010 are considered likely to more quickly absorb the water and come into contact with inks in the ejection ports and more easily be drawn into the ejection ports, causing the color mixing. To avoid such a problem, this embodiment calculates the elapsed time R by setting the coefficients e and f to 0.8 and 0.2, respectively, to give the capping period C, during which the color mixing is considered highly likely to occur, four times the weight assigned to the non-capping period H, and then summing up the capping period C and the non-capping period H.

Returning to step S5010 again, if the decision by step S5010 is positive, i.e., if the derived elapsed time R from the previous wiping operation time W is less than the threshold value Rth, no color mixing will occur the elapsed time after the wiping operation. So, the sequence moves from step S5010 to step S5030. The threshold value Rth in this embodiment is set at 10 (minutes) based on the result of the experiments conducted by the inventors of this invention.

At step S5030, the pre-printing cleaning ejection using the ink volume Q specified in table A of FIG. 6, i.e., the pre-printing cleaning ejection using the ejection failure elimination ink volume Q according to the resting time T from the end time of the last printing operation to the start time of the current printing operation, is executed. The subsequent sequence is similar to that performed when the decision by the step S5003 is negative, and thus its explanation is omitted here.

If on the other hand the decision by step S5010 is negative, i.e., the derived elapsed time R from the previous wiping operation time W is equal to or greater than the threshold value Rth, the color mixing is likely to occur the elapsed time after the wiping operation. So, the sequence moves to step S5020 where it checks whether the resting time T from the end time of the last printing operation to the start time of the current printing operation is less than the predetermined threshold period Tth.

Here, the threshold period Tth is 1 hour in this example. This value of 1 hour is taken from the table A, which shows a relation between the resting time T and the pre-printing cleaning ejection volume Q that increases with the resting time T, and represents a case where the pre-printing cleaning ejection volume Q is the threshold Qth (color mixing elimination ink volume) when the resting time T is the threshold period Tth. The value of the color mixing elimination ink volume Qth in this case is 1,000 pulses as described above.

If the decision by step S5020 is negative, i.e., if the resting time T is more than the threshold period Tth, the ejection failure elimination ink volume Q has already reached the color mixing elimination ink volume Qth. So, the sequence moves to step S5030 where it executes the pre-printing cleaning ejection using the ink volume Q based on the table A of FIG. 6, i.e., the pre-printing cleaning ejection using the color mixing elimination ink volume. The subsequent sequence is similar to that performed when the decision by step S5003 is negative. So, its explanation is omitted here.

If on the other hand the decision by step S5020 is positive, i.e., if the resting time T is less than the threshold period Tth, the pre-printing cleaning ejection using the ink quantity Q in table A may not be able to eliminate the color mixing that may occur the elapsed time after the wiping operation. So the sequence proceeds to step S5021. The processing executed by step S5021 involves increasing the ink volume to be used by the pre-printing cleaning ejection to the color mixing elimination ink volume Qth. Then, at step S5022 the pre-printing cleaning ejection using the color mixing elimination ink volume Qth is performed.

With step S5022 complete, the sequence proceeds to step S5023 where it resets the pre-printing cleaning ejection volume increase flag in the NVRAM 2050 to "0". Then, at step S5050, the printing operation on a print medium is started. The subsequent sequence is similar to that performed when the decision by step S5003 is negative, so its explanation is omitted here.

With the above control configuration of the inkjet printing apparatus, it has been found that, when compared with the first embodiment, the color mixing that may occur the elapsed time after the wiping operation can be prevented while at the same time minimizing the amount of waste ink from the pre-printing cleaning ejections.

Third Embodiment

A third embodiment of this invention will be described by referring to the drawings. Since the basic construction of this embodiment is similar to the first embodiment, only the characteristic construction will be explained.

In the first and second embodiment, an inkjet printing apparatus that performs the cleaning ejection into the cleaning ejection ink receiver 1040 has been described. In this third embodiment, an inkjet printing apparatus will be described which executes the cleaning ejection into the cap 1020. By performing the cleaning ejection into the cap 1020, the width of the inkjet printing apparatus (in the direction of arrow X in FIG. 1) can be reduced. Further, in the first and second embodiment, the cleaning ejection of yellow, magenta, cyan and black ink into the cleaning ejection ink receiver 1040 is done as the carriage 1100 is scanned in the direction of arrow X. In the third embodiment, however, since the cleaning ejection of each color ink is done into the cap 1020, the time it takes to execute the cleaning ejection can also be reduced.

Figure 7:
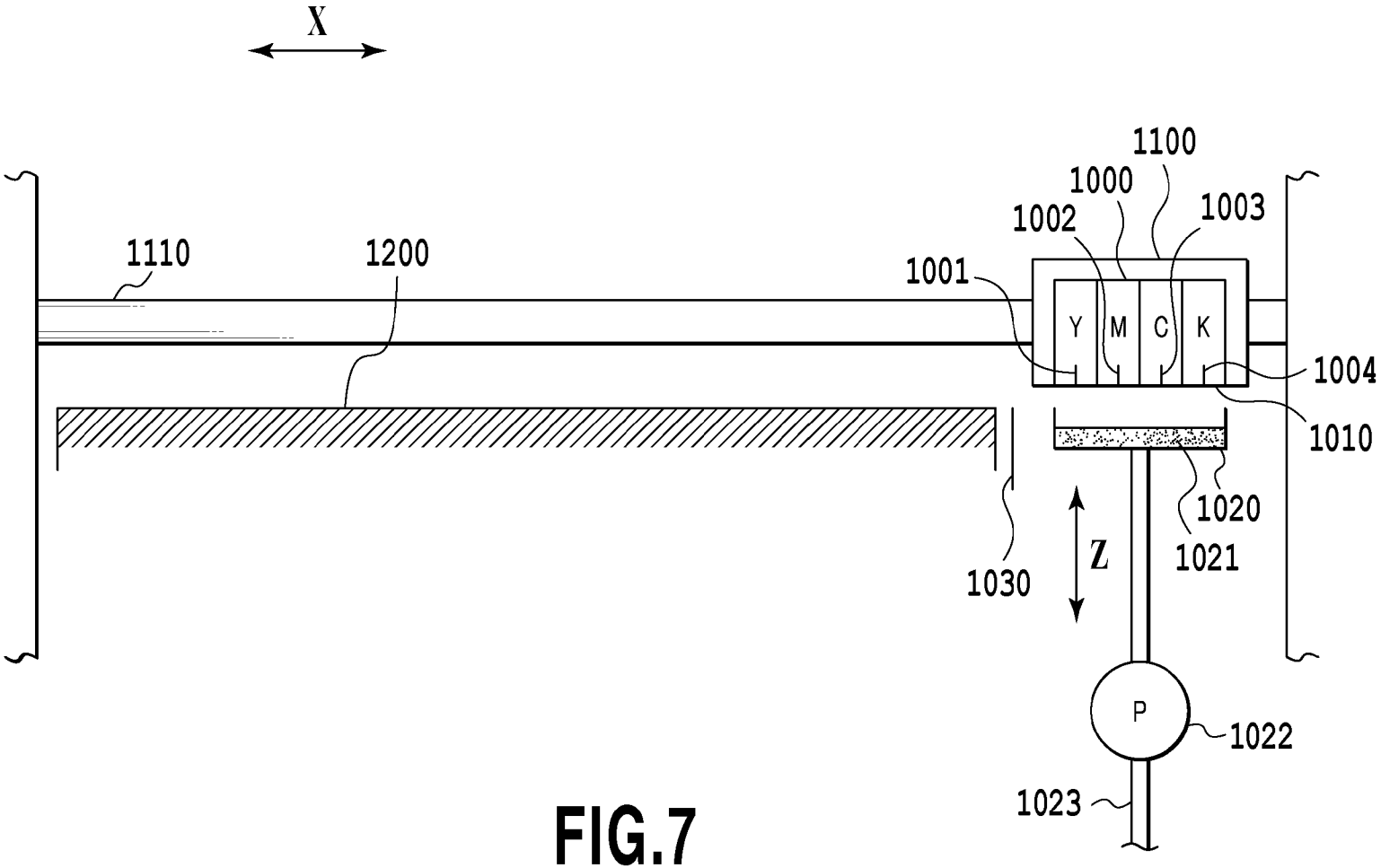
FIG. 7 is a schematic cross section showing an inkjet printing apparatus of a third embodiment.

FIG. 7 shows a schematic cross section of the inkjet printing apparatus to which this invention is applicable. In FIG. 7, parts with the same reference numbers as those in FIG. 1 have the similar functions, so their explanation will be omitted. Further, the block diagram of the control system for the inkjet printing apparatus in this embodiment is similar to FIG. 2. So, its explanation will be omitted.

In FIG. 7, a suction pump 1022 draws ink that was ejected into the cap 1020 by the cleaning ejection toward a waste ink container not shown through a tube 1023. A print sequence in this embodiment of the inkjet printing apparatus with the above construction will be explained. As for the flow chart, this embodiment only differs from the flow chart of FIG. 5 in that, just before the closing of the cap in step S5056, a step is inserted to draw the ink ejected into the cap 1020 by the cleaning ejection toward the waste ink container by operating the suction pump 1022. So, the detailed explanation of the flow chart is omitted here. It is noted that the suction pump 1022 is operated for 5 seconds. As for the table that shows the relation between the resting time T from the end time of the last printing operation to the start time of the current printing operation and the ejection failure elimination ink volume Q used in the pre-printing cleaning ejection, it is the same as that of second embodiment.

It is noted, however, that the threshold value Rth in step S5010 of FIG. 5 in this embodiment is 5, as opposed to 10 in the second embodiment. The reason for this is that the threshold value Rth is determined based on the result of the experiments that the inventors of this invention have conducted in the inkjet printing apparatus controlled to execute the cleaning ejection into the cap 1020. These experiments have shown that in such an inkjet printing apparatus, the color mixing may still occur even if the derived elapsed time R from the previous wiping operation time W is 5. The cause of this phenomenon may be explained as follows. The increased humidity in the closed space of the cap surrounding the ink ejection port surface 1010 is higher in the inkjet printing apparatus of this embodiment than in the second embodiment.

When the increased humidity in the closed space is high, the mixed color inks that have escaped being removed by the wiper blade 1030 and remained on the ink ejection port surface 1010 are considered to absorb water and spread more quickly to come into contact with inks in the ejection ports and more easily be drawn into the ejection ports. For this reason, the threshold value Rth in this embodiment is set at 5.

With the above construction and control, it has been found that, in the inkjet printing apparatus constructed to eject inks into the cap 1020 by the cleaning ejections, too, the color mixing that may occur the elapsed time after the wiping operation can be prevented while at the same time minimizing the amount of waste ink produced by the pre-printing cleaning ejections.

Other Embodiments

In the second and third embodiment, the derived elapsed time R is calculated as follows based on the capping period C from the previous wiping operation time W and the non-capping period H.

(Derived elapsed time $R$)=$e$×(capping period $C$ from previous wiping operation time $W$)+$f$×(non-capping period H from previous wiping operation time $W$)

where coefficients e and f are 0.8 and 0.2, respectively.

This invention is not limited to the above-defined elapsed time. Coefficients e and f used to multiply the capping period C and the non-capping period H, respectively, may take other values than 0.8 and 0.2. The method of deriving the elapsed time may also be other than what has been shown in the second and third embodiment.

Installing a temperature/humidity sensor in the inkjet printing apparatus to detect temperature and humidity of ambience to allow the elapsed time R deriving method to be modified according to the temperature and humidity detected is more preferable as it can define with higher accuracy a situation where the color mixing can occur the elapsed time after the wiping operation.

Further, the first to third embodiment have been described to employ a so-called lateral wiping technique whereby the carriage 1100 is moved in the direction of arrow X with the wiper blade 1030 fixed at the wiping position to wipe the ejection port face of the print head. This invention is not limited to such a wiping technique. For example, a so-called vertical wiping technique may be used whereby the wiper blade itself is moved in the Y direction. This is as effective as the first one. Further, the wiper itself does not have to be blade-shaped.

Further, while in the first to third embodiment the wiping operation is controlled to be performed at the end of the printing operation, it is possible to halt the printing operation temporarily to execute the wiping operation.

Furthermore, the first to third embodiment have been described to employ a thermal type inkjet print head 1000 that has electrothermal converters or heaters formed one in each ink ejection port. This invention, however, is not limited to such a construction but can employ as effectively a piezoelectric type inkjet print head formed with a piezoelectric element in each ink ejection port.

Furthermore, the first to third embodiment have taken up for example a serial scan type inkjet printing apparatus, which performs the printing operation by scanning the carriage 1100 in the direction of arrow X to eject inks onto a print medium while the print medium is held static between its intermittent conveyance operations. This invention, however, is not limited to such a construction. For example, this invention can also be applied as effectively to a full line type inkjet printing apparatus that uses a full line type inkjet print head longer than the width of the print medium as measured in a direction perpendicular to the print medium conveyance direction.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2010-172566, filed Jul. 30, 2010, which is hereby incorporated by reference herein in its entirety.

What is claimed is:

1. An inkjet printing apparatus comprising:

a printing head having an ink ejection port surface in which a plurality of ink ejection ports ejecting a plurality of color inks are formed;

a wiping unit configured to wipe the ink ejection port surface;

an elapsed-time measuring unit configured to measure an elapsed time from a previous wiping operation;

a resting time measuring unit configured to measure a resting time from an end of a previous printing operation to a start of a next printing operation; and a preliminary ejection unit configured to cause the printing head to eject an ink amount decided based on the resting time, wherein the preliminary ejection unit is further configured to cause the printing head to eject a predetermined amount of ink when:

(i) the elapsed time is equal to or greater than a predetermined time period, and (ii) an ink amount decided based on the resting time is less than a predetermined amount.

2. An inkjet printing apparatus according to claim 1, wherein, after the wiping unit has performed a wiping operation, the preliminary ejection unit performs the preliminary ejection.

3. An inkjet printing apparatus according to claim 1, wherein the wiping unit comprises a wiping member that wipes the ink ejection port surface of the printing head in which the plurality of ink ejection ports are formed.

4. A method of controlling an inkjet printing apparatus comprising a printing head that includes an ink ejection port surface in which a plurality of ink ejection ports are formed, comprising the steps of:

measuring an elapsed time from a previous wiping operation of wiping the ink ejection port surface with a wiping member;

measuring a resting time from an end of a previous printing operation to a start of a next printing operation; and performing a preliminary ejection from the printing head, wherein a predetermined amount of ink is ejected during the preliminary ejection when:

(i) the elapsed time is equal to or greater than a predetermined time period, and (ii) an ink amount, decided based on the resting time is less than a predetermined amount.

* * * * *